US012409960B2

(12) United States Patent
Ericson et al.

(10) Patent No.: US 12,409,960 B2
(45) Date of Patent: Sep. 9, 2025

(54) SIMULTANEOUS MULTIPLE PACKAGE CASE PACKER

(71) Applicant: Delkor Systems, Inc., St. Paul, MN (US)

(72) Inventors: Jeremiah Ericson, Andover, MN (US); Nicholas E. Kaiser, St. Francis, MN (US); Nicholas A. Orfei, North St. Paul, MN (US)

(73) Assignee: Delkor Systems, Inc., St. Paul, MN (US)

( * ) Notice: Subject to any disclaimer, the term of this patent is extended or adjusted under 35 U.S.C. 154(b) by 81 days.

(21) Appl. No.: 18/524,079

(22) Filed: Nov. 30, 2023

(65) Prior Publication Data

US 2025/0178760 A1 Jun. 5, 2025

(51) Int. Cl.

| | |
|---|---|
| ***B65B 35/24*** | (2006.01) |
| ***B65B 5/04*** | (2006.01) |
| ***B65B 35/18*** | (2006.01) |
| ***B65B 35/56*** | (2006.01) |
| ***B65B 57/10*** | (2006.01) |

(52) U.S. Cl.

CPC ..... *B65B 5/04* (2013.01); *B65B 35/18* (2013.01); *B65B 35/24* (2013.01); *B65B 35/56* (2013.01); *B65B 57/10* (2013.01)

(58) Field of Classification Search

USPC ..... 53/473

See application file for complete search history.

(56) References Cited

U.S. PATENT DOCUMENTS

2013/0298500 A1* 11/2013 Laudet ..... B65B 5/06 53/284.5

2016/0137326 A1* 5/2016 Hutter ..... B65B 57/14 53/247

* cited by examiner

*Primary Examiner* — Chinyere J Rushing-Tucker

(74) *Attorney, Agent, or Firm* — Forsgren Fisher McCalmont DeMarea Tysver LLP; James M. Urzedowski; Daniel A. Tysver

(57) ABSTRACT

A system, its components, and method of operation for loading articles into multiple cases is presented and includes a robotic assembly having a vertical arm movably connected to a frame at one end and a rail centrally engaged at the other. At least two end of arm tools (EOATs) are engaged to the rail, with each EOAT being capable of independent and coordinated sliding and rotational movement relative to the rail. A sensor is positioned above an upstream location of an article conveyor to detect speed, position and orientation characteristics of articles and communicating those characteristics to the robotic assembly. The robotic assembly is configured to move each of the EOATs to match the speed, position and orientation of one of the articles, and then, pick up each article, and transport each article to one of a plurality of cases positioned in a loading area.

7 Claims, 21 Drawing Sheets

SIMULTANEOUS MULTIPLE PACKAGE CASE PACKER

TECHNICAL FIELD

Embodiments disclosed herein relate to case packing apparatuses, systems, and methods. Some specific embodiments are directed to a robotic case packing system for loading multiple articles from a moving conveyor into one or more cases, such as corrugated cardboard boxes.

BACKGROUND

In the field of case packaging there is a constant desire to develop improved systems for picking up articles from a conveyor and placing those articles within a case, such as a corrugated cardboard box or similar case. The goal is to accomplish this task with ever greater speed, accuracy and efficiency and at lower cost and complexity. In striving toward this goal, multi-axis robotic arms have been developed that are capable of quickly moving articles from a conveyor and then depositing those articles into case packages. Many systems employ several such robotic arms to allow more articles to be packaged more quickly. As robotics tend to be expensive and space is often limited, systems utilizing multiple robotic arms are expensive, bulky and cumbersome.

Moreover, existing robotic arms are often limited in their capability as they rely on precise positioning and conveyance speed in order for the packaging system to perform efficiently. Variations in article placement, orientation, or movement will styme the arm's ability to properly engage and pick-up the article from the conveyor, resulting in missed or misplaced article deposition, which can have negative downstream effects (e.g., cases not packed properly, conveyor blockage, etc. that may result in the packaging system being shut down to address the problem).

Embodiments disclosed herein avoid the problems associated with known robotic arms, by utilizing a packaging system which includes a visual scanner coupled with a unique multi-axis robotic arm assembly that has multiple end of arm tools (EOATs), each of which are capable of independent movement and function. Embodiments of the robotic arm assembly disclosed herein are configured to move the EOATs to match the speed, position, and orientation of as many product articles present on the conveyor as there are EOATs. Such embodiments thus avoid the need of having multiple robotic arms or the precise coordination requirements that many existing packaging systems require.

SUMMARY

A multiple product case packing system includes a moveable robotic assembly supported by a frame, the assembly includes a robotic arm that is moveable within the frame along three axes. The arm supports a rail to which at least two EOATs are moveably engaged. Each EOAT is independently movable relative to the rail and has of four degrees of freedom.

The robotic arm is capable of movement along an X-axis and Y-axis, which allows the assembly to be moved between a pick area of a conveyor and a case loading area, and to match the speed of product articles advancing on the conveyor. The robotic arm is also capable of movement along a Z-axis (up and down relative to the pick area and case loading area).

The rail is centrally engaged to an end of the robotic arm and is capable of rotating or pivoting relative to the robotic arm along the X and Y axes. In some embodiments, the rail is also capable of angling itself vertically in relation to the robotic arm in (tilting). The range of motion provided by the rail relative to the robotic arm, allows the assembly to position each EOAT that is engaged to the rail, over a product article within the pick area regardless of the relative position of the articles on the conveyor.

Each of the EOATS can slide independently along the rail in a coordinated manner and can rotate to match the orientation of a product article positioned on the conveyor, and if necessary, subsequently adjust the products orientation to match the packaging requirements of a container or case that the article is to be deposited within. It should be noted that as a result of the independent and coordinated performance parameters that each EOAT is capable of, allows the use of multiple common or different shaped/sized product cases to be utilized by the system.

When each of the EOATs has matched the speed, position, and orientation of a corresponding product article, the arm descends along the Z-axis allowing each of the EOATs to grip or otherwise engage one of the product articles. The arm then ascends back to its nominal position along the Z-axis, and then the entire assembly moves from the pick area to the load area, whereupon the EOATs and rail are repositioned over one or more open product cases and the product articles are released to be deposited therein. The assembly is then free to return to the pick-area to acquire the next group of product articles and repeat the pick and load cycle.

DETAILED DESCRIPTION

Figure 1:
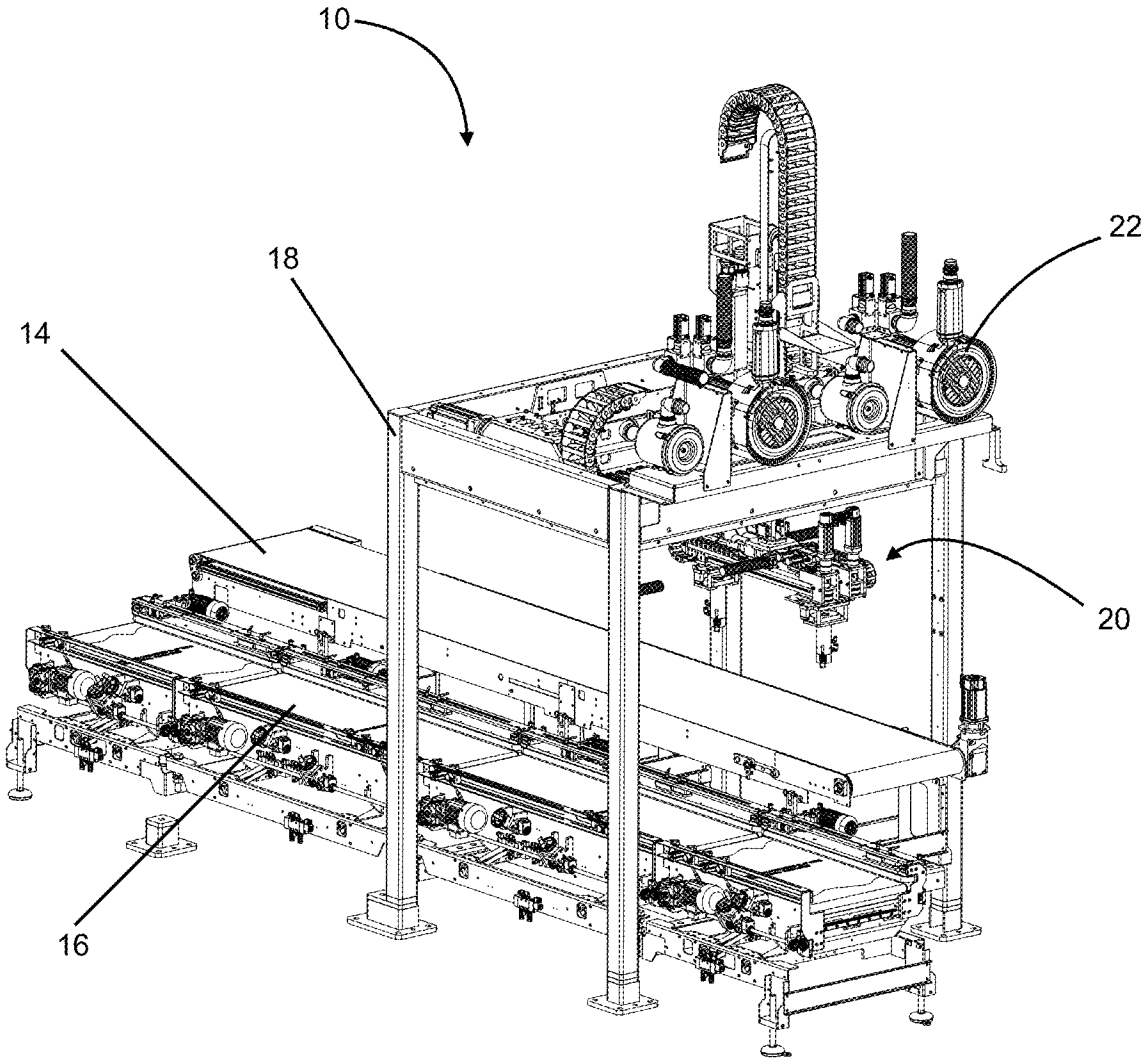
FIG. 1 is a side perspective view of a multiple product case packing system.

Referring to FIG. 1, a multiple product case packing system 10 according to the present disclosure is shown. In addition to an up stream sensor 12 (not visible in FIG. 1, but shown in FIGS. 4-11), the system 10 includes an article conveyor 14, a box or case loading conveyor 16, and a gantry or frame 18, from which the robotic arm assembly 20 is mounted and contained.

Figure 2:
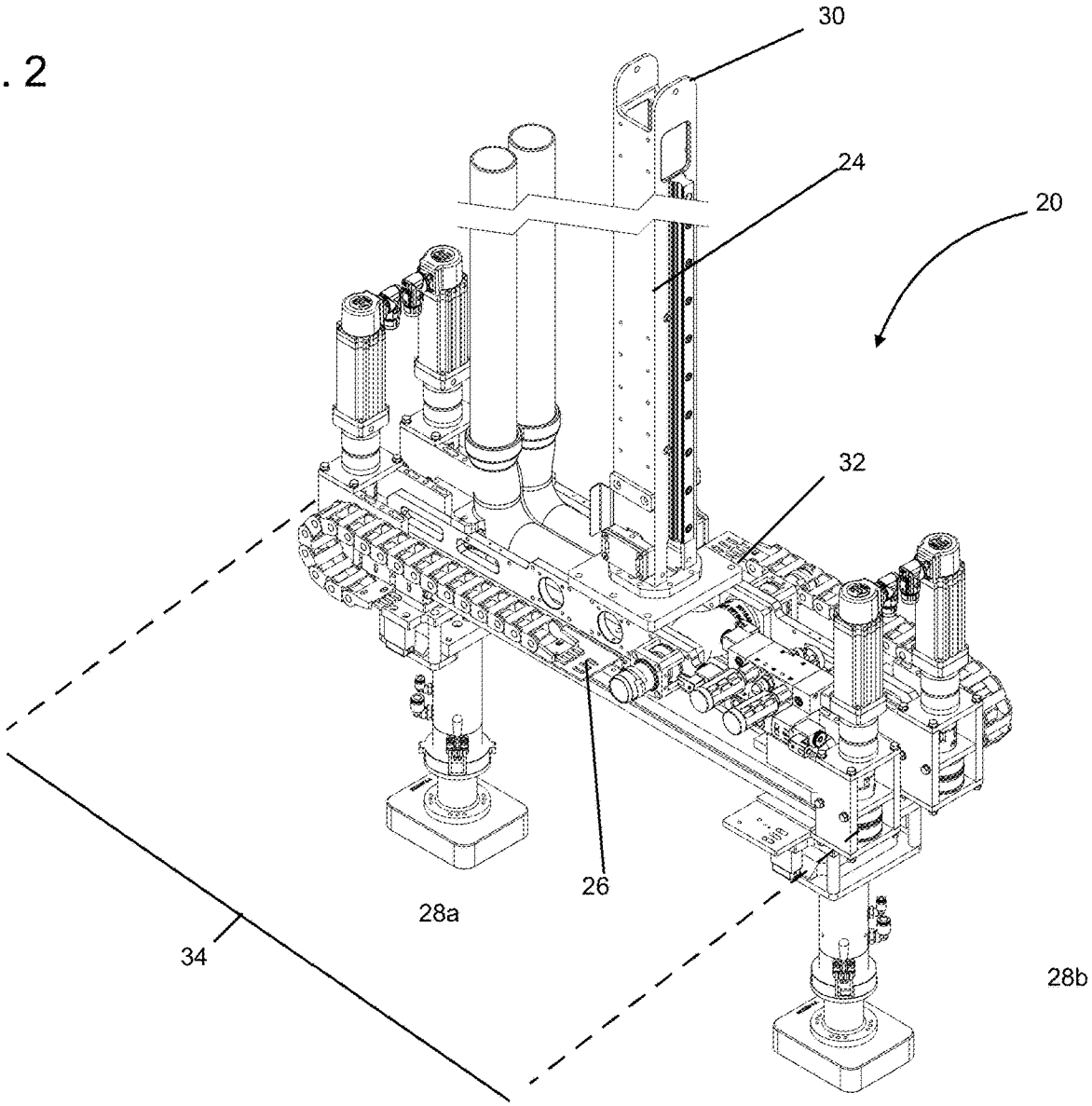
FIG. 2 is a side perspective view of a robotic arm assembly utilized by the multiple product case packing system shown in FIG. 1.
Figure 3:
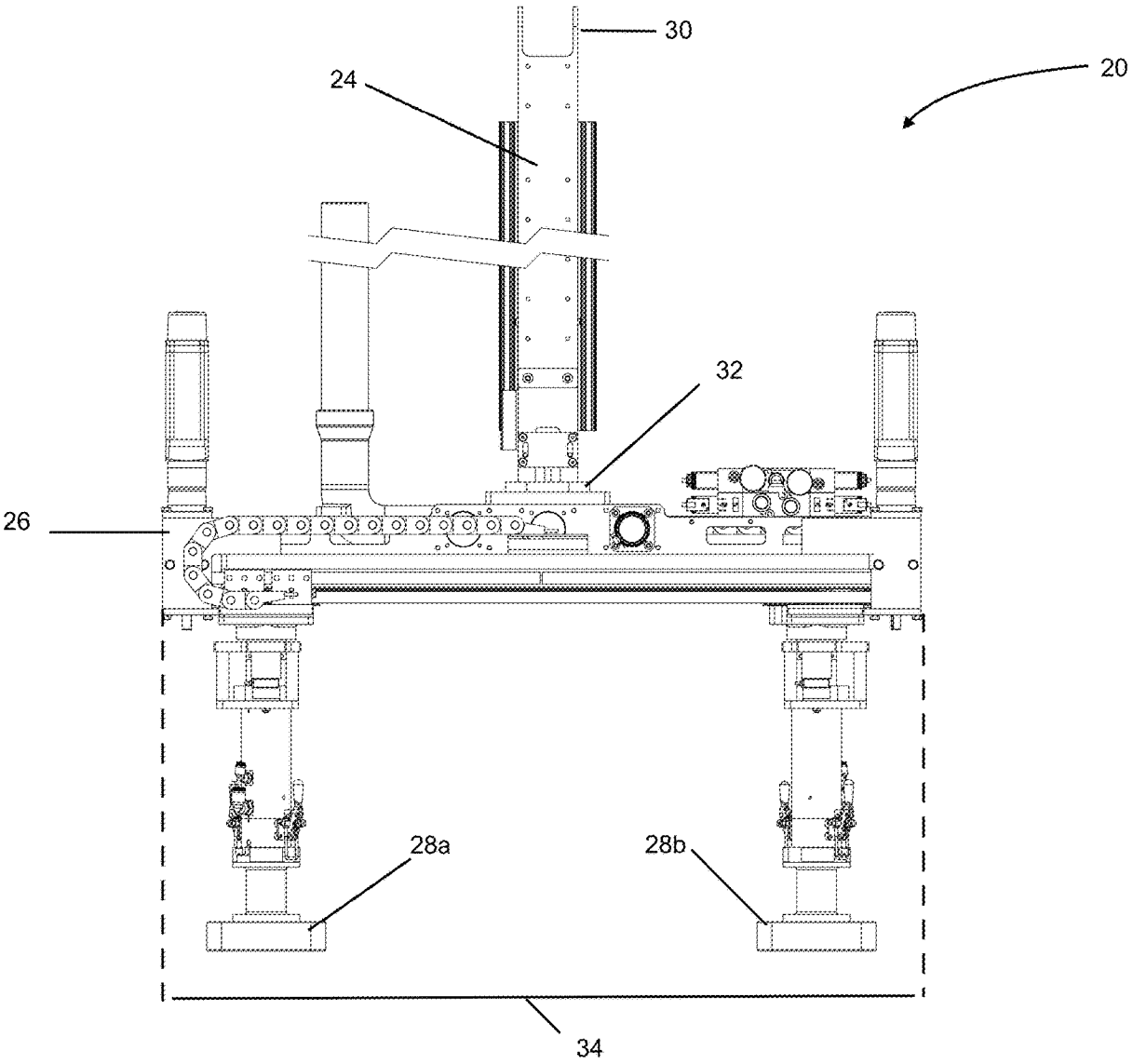
FIG. 3 is a side view of the robotic arm assembly shown in FIG. 2.
Figure 4:
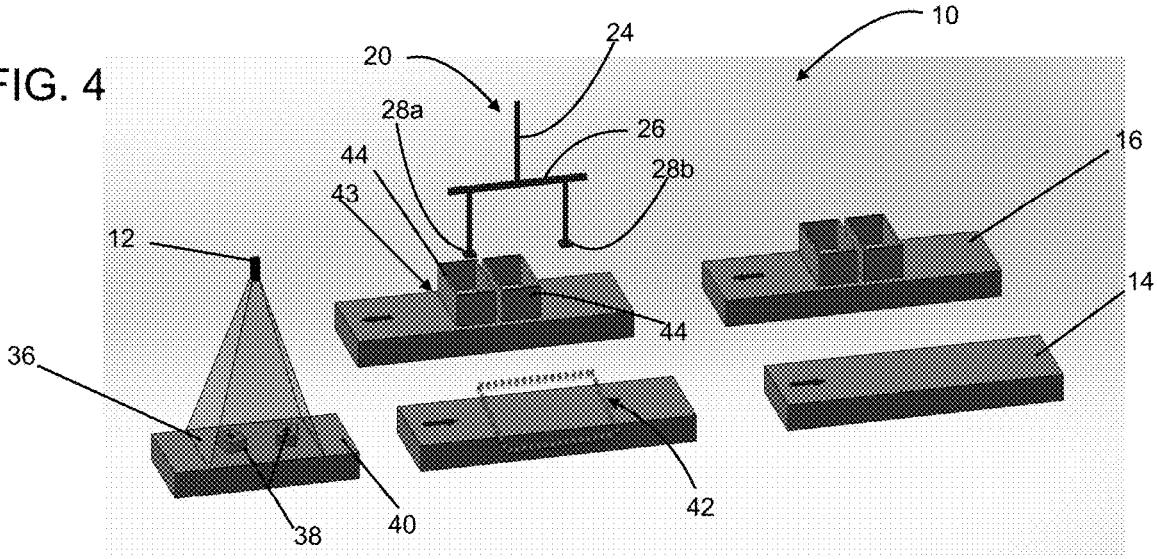
FIGS. 4-11 are side perspective component views of the system shown in FIG. 1 illustrating the sequence of operation.

In at least one embodiment, the assembly 20 is driven by one or more servo motors, motor arrays, or other type of robotic actuator(s) 22 and is freely moveable along three axis (X, Y, and Z) relative to the frame 18 via a series of tracks, rails, drive shafts, etc., supported by the frame 18 in a conventional manner that will be recognized and understood by those of ordinary skill in the art. A detailed view of the assembly 20 is shown in FIGS. 2 and 3.

The primary components of the assembly 20 include a support drive shaft (arm) 24, a lateral rail (rail) 26 and at least two EOATs 28*a* and 28*b*. The arm 24 has an apex 30 and a base 32. At the apex 30, the arm 24 is engaged to the actuator 22 (shown in FIG. 1). At the base 32, the arm 24 is engaged to a center point of the rail 26 (i.e., an equal portion of the length 24 extends laterally from the end of the base 32 of the arm 24). Each of the EOATs 28*a* and 28*b* are moveably engaged to the rail 26 and are capable of independent and coordinated sliding motion along its length 34. Independent and coordinated sliding motion as used herein refers to the ability of each EOAT to move along the length of the rail 26 independent of one another, but also in a controlled manner such that the EOATs will not collide or interfere with each other's movement.

In at least one embodiment, the robotic actuator 22 is in direct or indirect mechanical communication with each of the primary components of the assembly 20 to provide motivational force to each of those components in order to move the EOATs 28*a* and 28*b* to match the speed, position, and orientation of the articles detected by the sensor 12 in the manner shown in the operational sequences of FIGS. 4-26 and described below. In some embodiments, the system employs multiple actuators (not labeled), whereby an individual actuator is operatively engaged to each of the primary components to provide the required motivational force to move the respective components in the required manner.

In the various embodiments disclosed herein, the EOATs may be or include any type of actuatable tooling, such as for example: vacuum gripper, mechanical grippers, pneumatic grippers, etc.

Turning now to FIGS. 4-11 a series of component views of the system 10 are shown which depict the sequence of the system's operation and the unique movement characteristics that the assembly 20 provides. As used herein, "component views" refers to the depiction of only the primary elements of the system necessary to illustrate the movement profile of the assembly 20 and its capabilities.

In FIGS. 4-11, on the left of each image is shown the sensor 12 and the upstream sensor or scanning area 36 of the article conveyor 14. As the article conveyor 14 advances, product articles 38 are moved into the scanning are 36. The sensor 12 is any sort of motion detection sensor, such as a video motion optical sensor, LIDAR based sensor, passive infrared (PIR) light sensor, microwave sensor, ultrasonic sensor, etc. The sensor 12 detects the position and orientation of the articles 38 on the surface 40 of the article conveyor 14, as well as the rate or speed that the articles are moving via the conveyor 14, and communicates that collective data to the assembly 20.

In the center of each of FIG. 4-11 is shown the pick area 42 and load area 43 of the system 10. These areas are respectively portions of the article conveyor 14 and case loading conveyor 16 that extend adjacent to and/or within the confines of frame 18 and thus share their operational space with the assembly 20 contained therein.

To the right of each of FIGS. 4-11 is a portion of the case loading conveyor 16 and illustrates the manner in which the system 10 advances or otherwise positions open boxes or other types of cases 44 in to the load area 43; generally, one case 44 for each EOAT and/or article 38. Also shown is a downstream portion of the article conveyor 14. In some embodiments, cases 44 utilized by the system 10 may be of common physical characteristics (e.g. material, shape, size, opening size, etc.) or such characteristics may be different.

Figure 5:
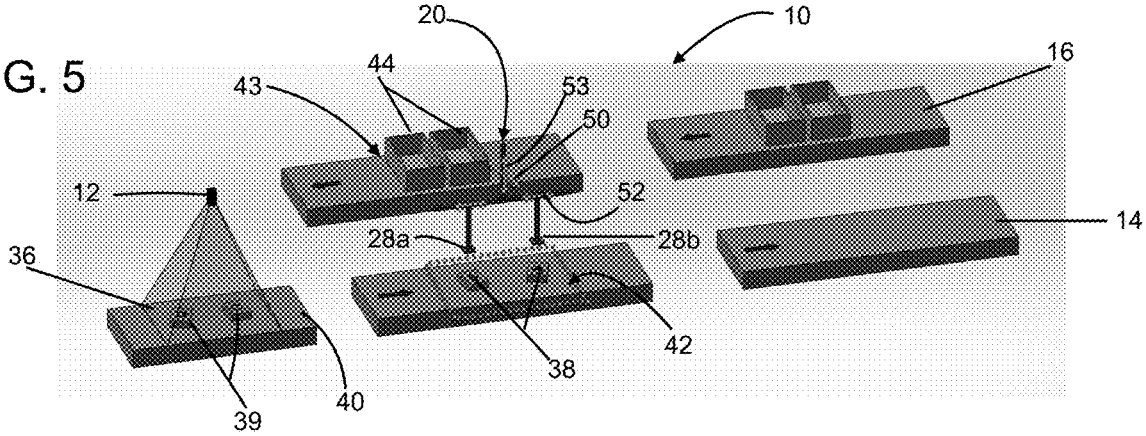
Figure 6:
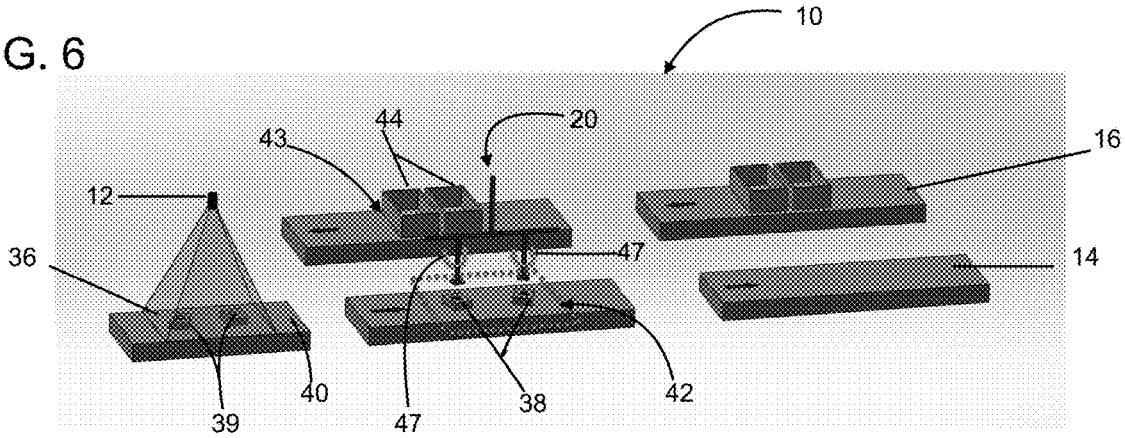

As shown in FIGS. 5-6, cases 44 are positioned in the load area 43 via the case loading conveyor 16, the article conveyor 14 advances scanned product articles 38 into the pick area 42. As this is occurring, the assembly 20 utilizes the data it has received from the sensor 12 to move along the X-axis 50 and Y-axis 52 (shown in FIG. 5) such that each EOAT 28*a* and 28*b* matches the speed, position, and orientation of an article 38 entering the pick area 42.

Figure 7:
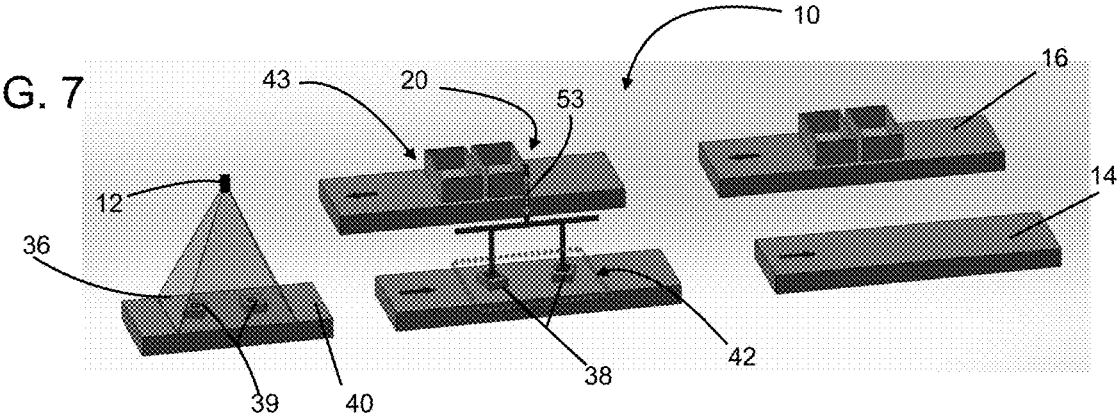
Figure 8:
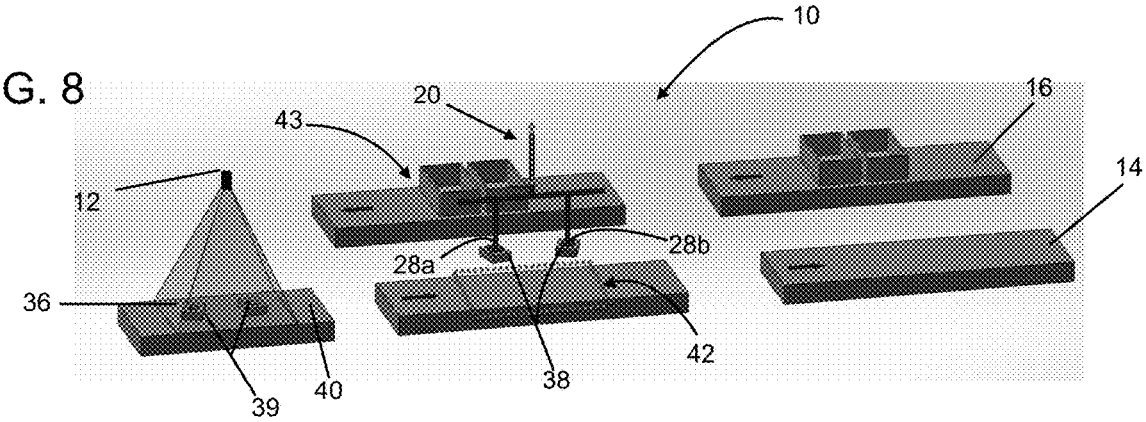
Figure 9:
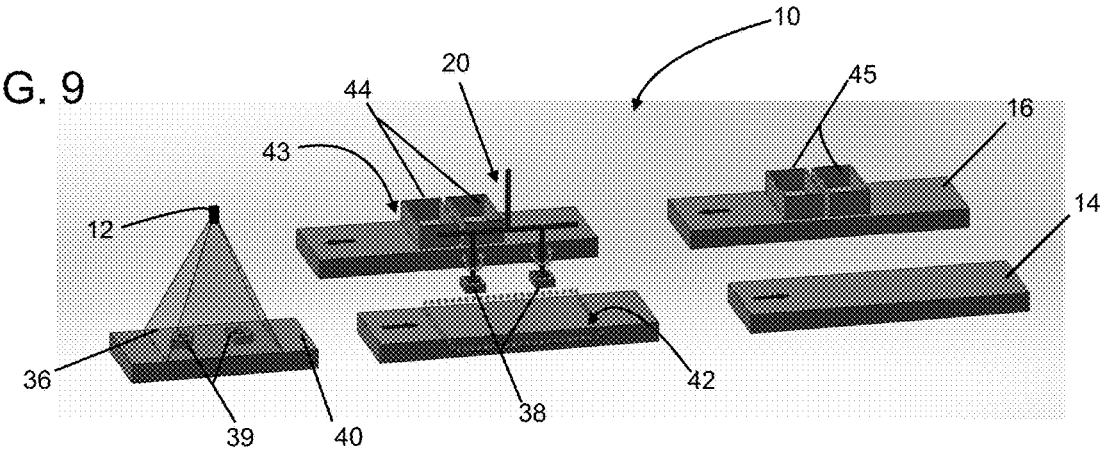
Figure 10:
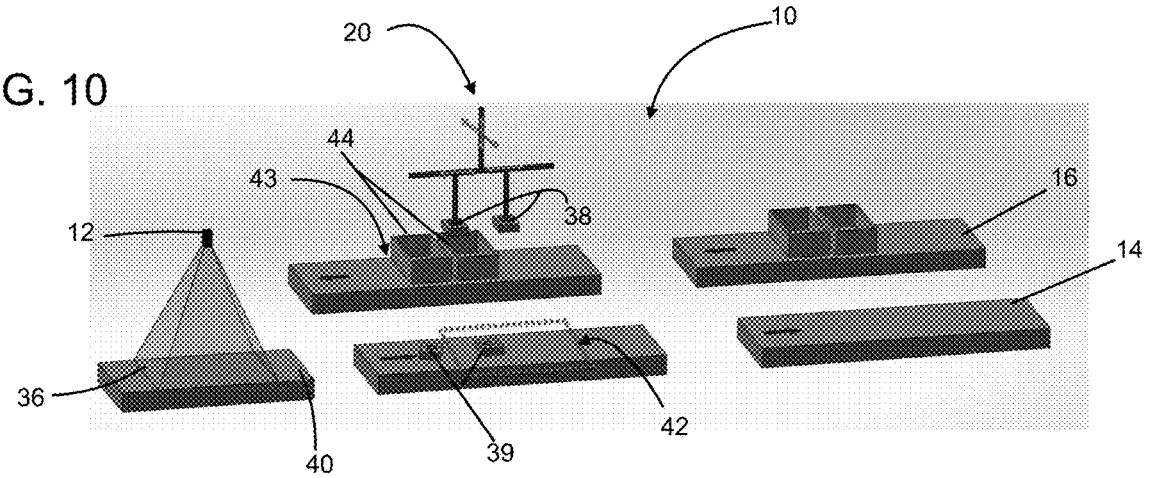
Figure 11:
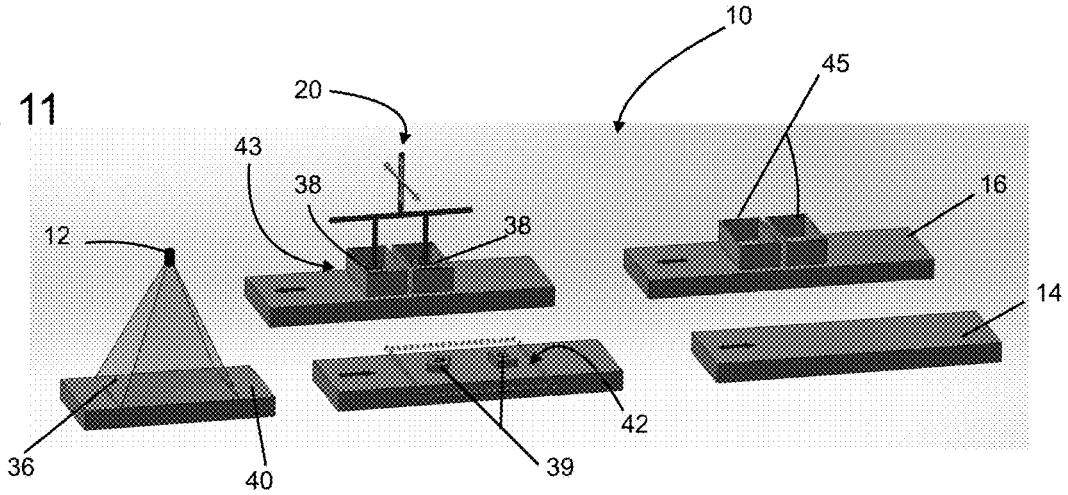
Figure 12:
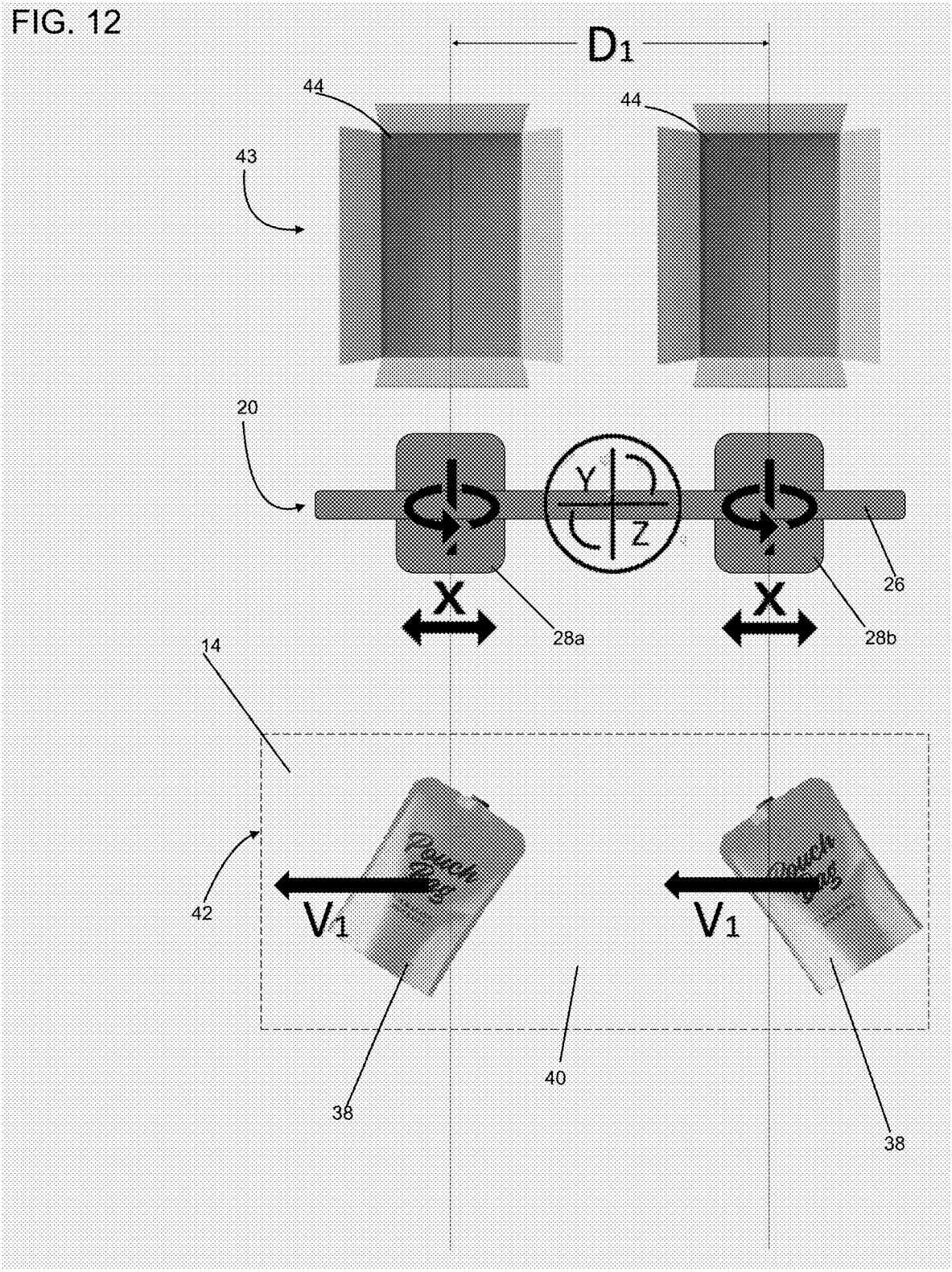
FIGS. 12-16 are top down conceptualized views of components of the system shown in FIG. 1 illustrating an operational sequence in which the speed, position, and orientation of multiple product articles having nonuniform orientations are matched by the robotic arm assembly.

Once each of the EOATs 28*a* and 28*b* have matched the speed, position, and orientation characteristics of an article 38, the arm 24 will lower the assembly 20 vertically along the Z-axis 53 shown in FIGS. 5 and 7, so that each EOAT 28*a* and 28*b* can engage and retain an article 38, such as in the manner shown in FIG. 7. Once the EOATs 28*a* and 28*b* have engaged their respective articles 38 the arm 24 will raise the assembly 20 vertically along the Z-axis 53, thereby lifting the articles 38 off of the surface 40 of article conveyor 14, such as in the manner shown in FIG. 8.

It should be noted that in FIGS. 4-8 the articles 38 are shown having no common or uniform orientation or placement on the surface 40 of article conveyor 14. As mentioned above, the assembly 20 is capable of positioning the EOATs 28*a* and 28*b* such that they individually match the speed and position of an article 38 entering the pick area 42. As FIG. 6 illustrates, each of the EOATs 28*a* and 28*b* are also capable or rotating about their longitudinal axis 46 (indicated by arrows 47), thereby allowing each EOAT 28*a* and 28*b* to match the orientation of an article before the article is picked up. This ability to rotate also allows the EOATs 28*a* and 28*b* to reorient articles 38 to that they line up with a desired packing position before being deposited into cases 44, such as in the manner shown in FIG. 9. Once the EOATs 28*a* and 28*b* reorient the articles 38 into a proper packaging position, the assembly 20 positions itself over the cases 44 within the load area 43 and deposits the articles 38 into their appropriate case in the manner shown in FIGS. 10 and 11. Once the articles 38 are thus deposited, the assembly 20 is ready to repeat the pick and load process with the next set of cases 45 and the next set of articles 39 that advance into the load area 43 and pick area 42 respectively.

An alternative, top down view, of this operation is shown in the sequence of FIGS. 12-16. In this depiction articles 38 are pouches of product that enter the pick area 42 with opposing angles of orientation, but positioned in a common longitudinal plane upon the surface 40 of the article conveyor 14.

Figure 13:
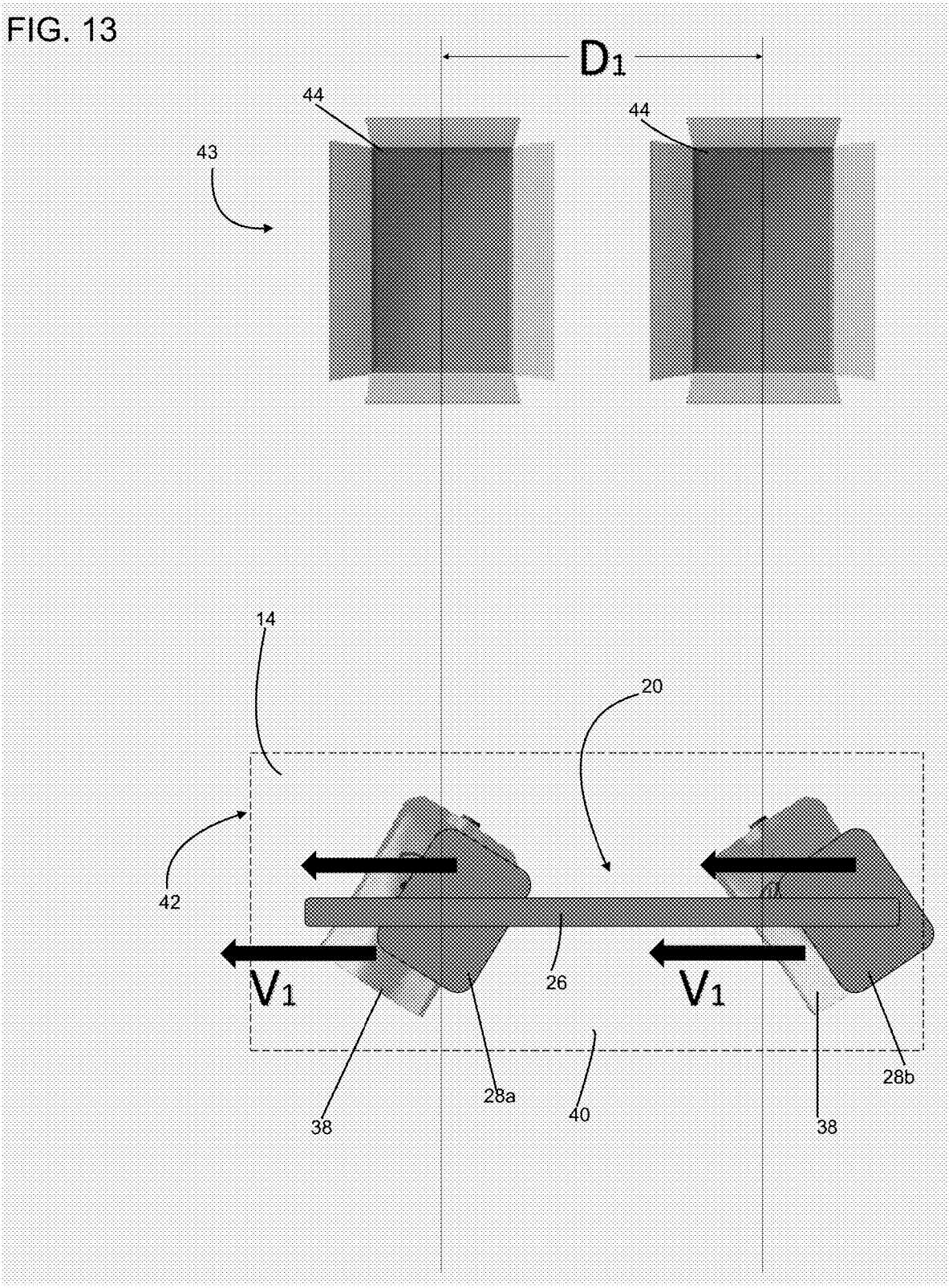
Figure 14:
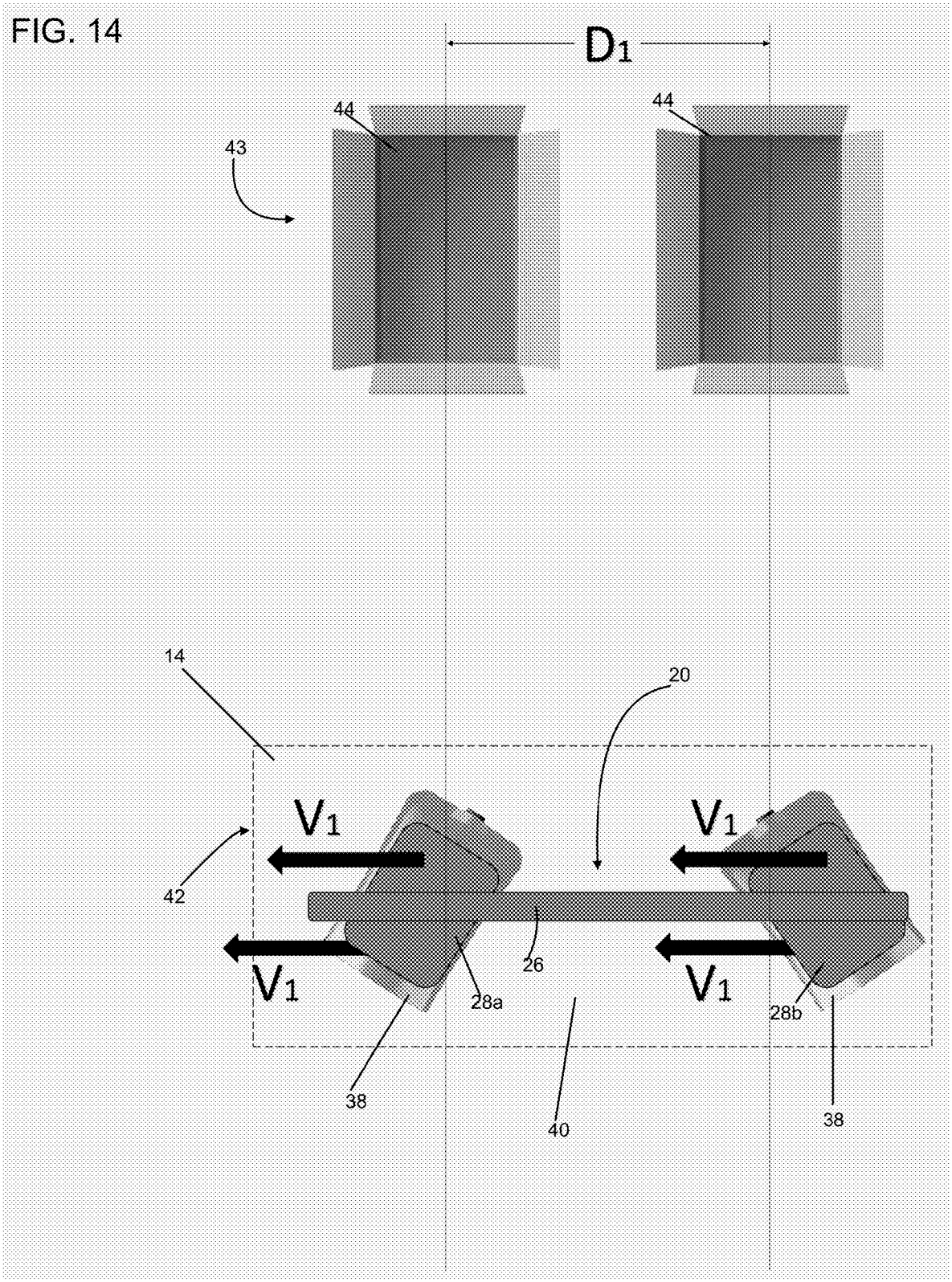
Figure 15:
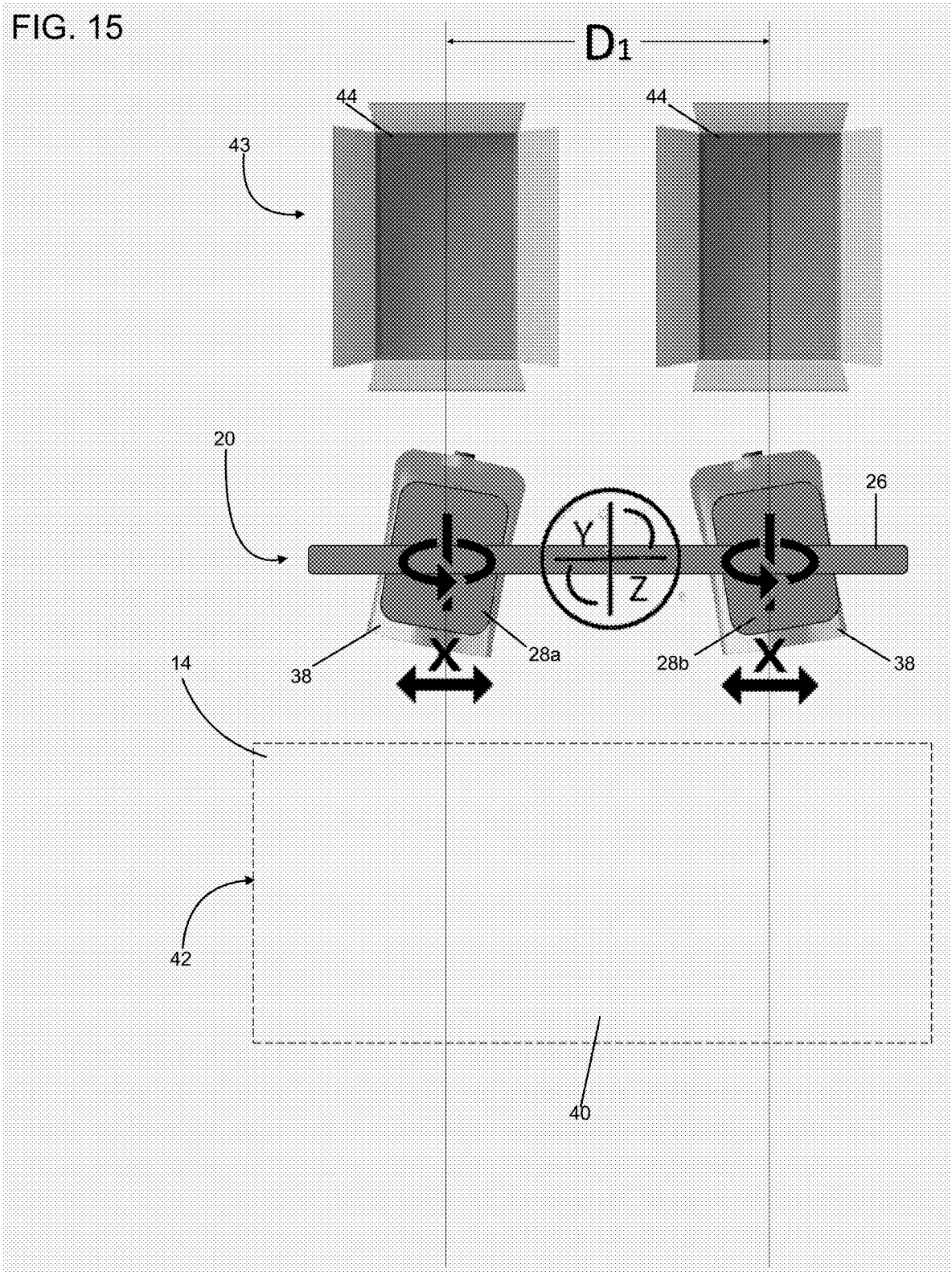
Figure 16:
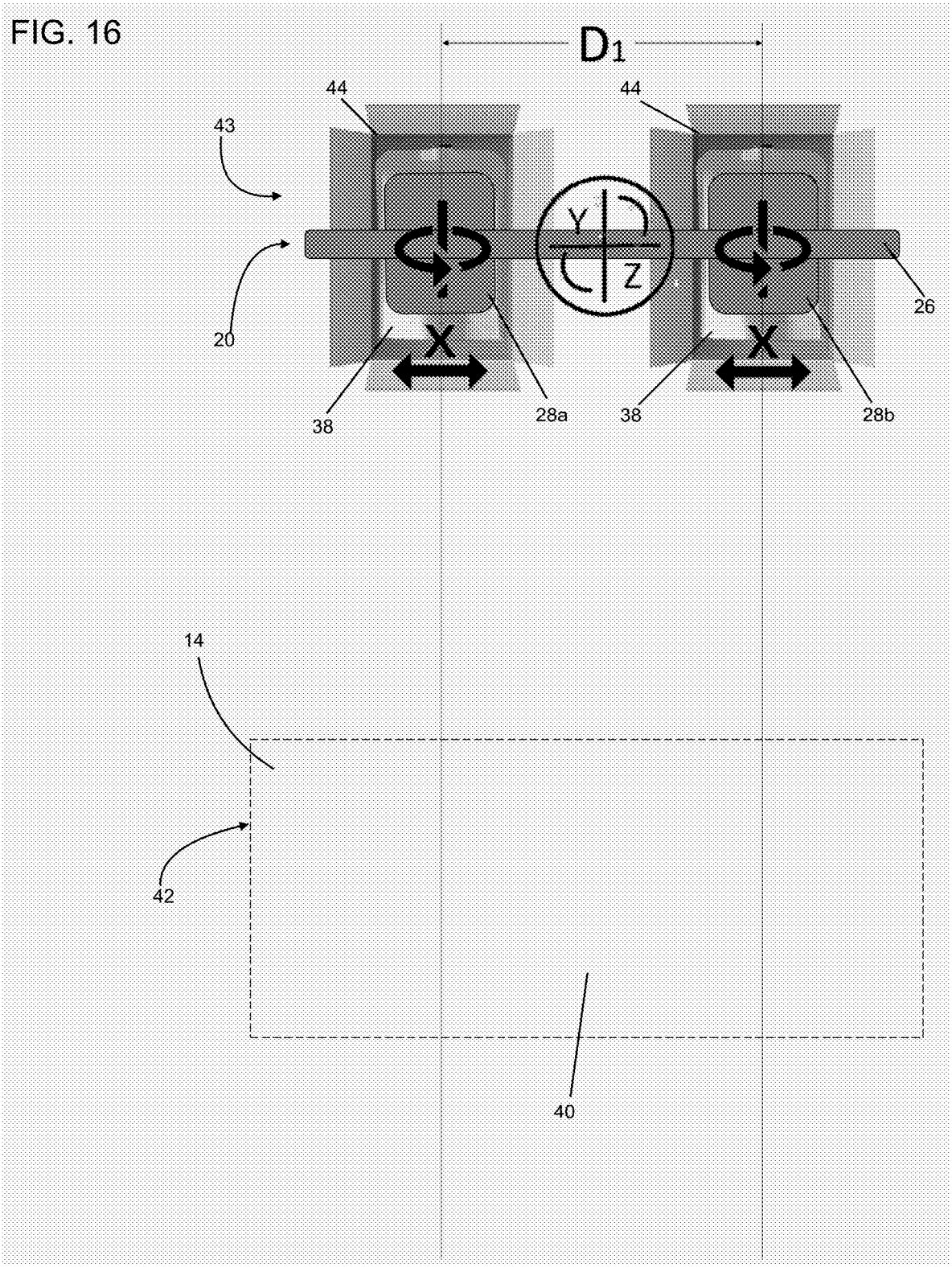
Figure 17:
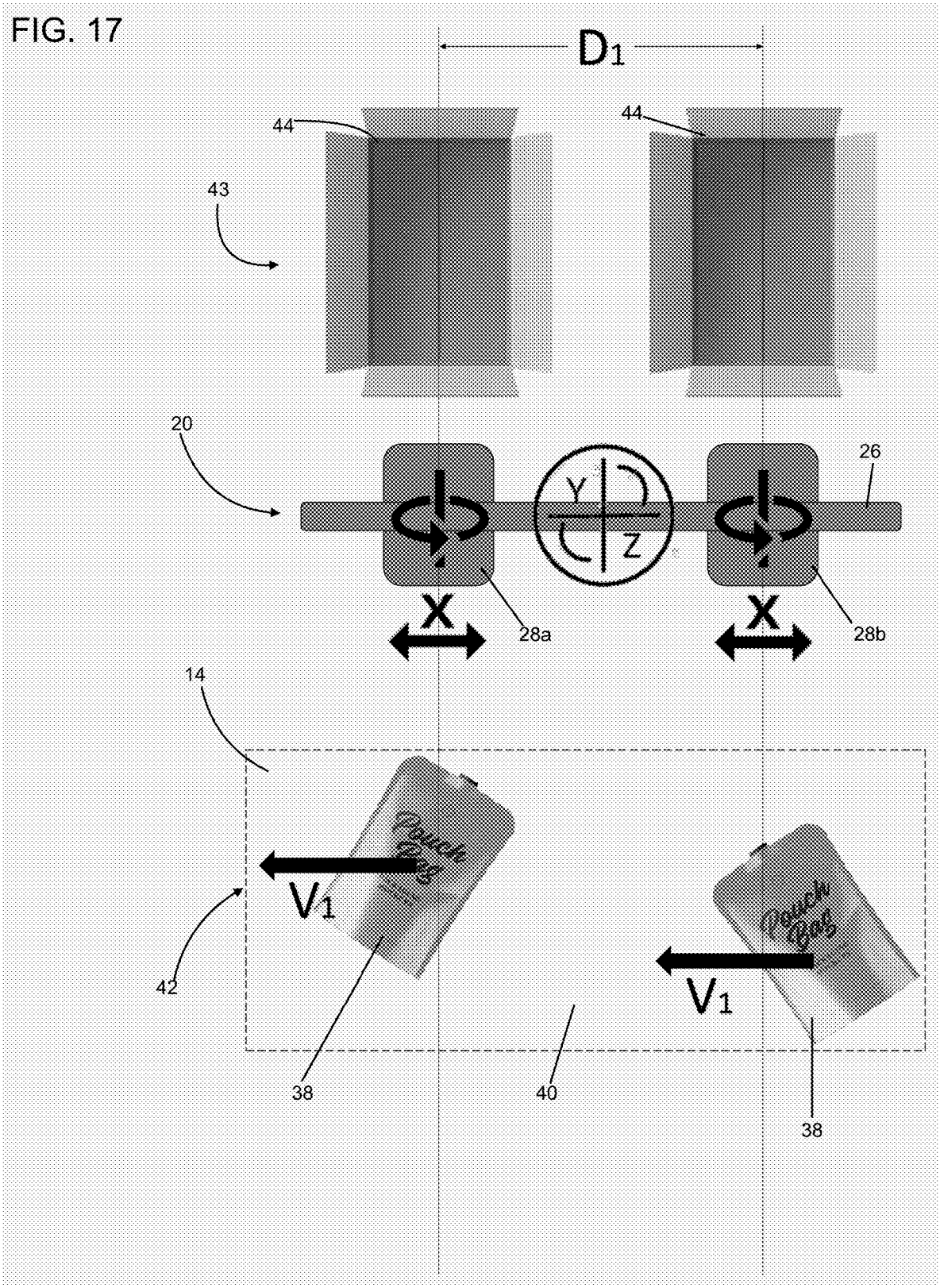
FIGS. 17-21 are top down conceptualized views of components of the system shown in FIG. 1 illustrating an operational sequence in which the speed, position, and orientation of multiple product articles that are laterally displaced and have nonuniform orientations are matched by the robotic arm assembly.

As depicted in FIGS. 13 and 14, in this circumstance, the assembly 20 will move toward the sensed articles 38 that are entering the pick area 42. As the assembly 20 advances it will reposition the EOATs 28*a* and 28*b* along the rail 26 to match the spacing of the articles as well as their conveyance speed (represented by arrow $V_1$). Each EOAT 28*a* and 28*b* will simultaneously be rotated to match the orientation of the articles 38 with which they are in proximity.

Once the speed, position and orientation of the EOATs 28*a* and 28*b* match those same attributes of the articles 38, the assembly will pick the articles up and off of the article conveyor 14 in the manner previously described above, and shown here in FIG. 15.

Once the articles 38 have been picked up, the assembly 20 moves to the waiting cases 44 that are positioned in the load area 43. Simultaneously, EOATs 28*a* and 28*b* will rotate as necessary to align the articles 38 with a desired packing position appropriate to each case 44 and then deposit each article 38 therein in the manner shown in FIGS. 15 and 16.

In FIGS. 17-21 the same operational process of the system 10 is once again show, but where the articles 38 are shown with different orientations as well as being both laterally and longitudinally displaced upon within the pick area 42.

Figure 18:
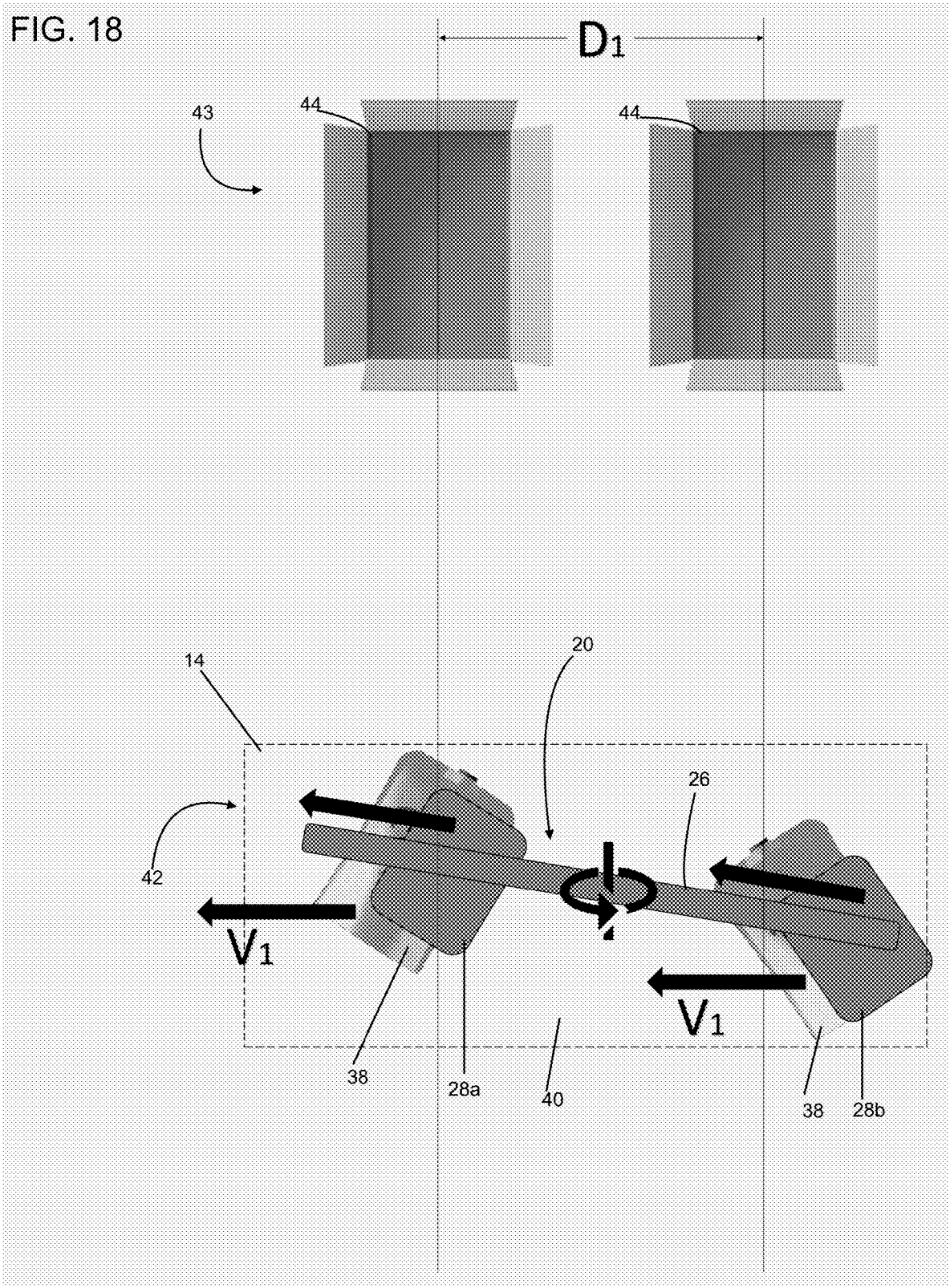
Figure 19:
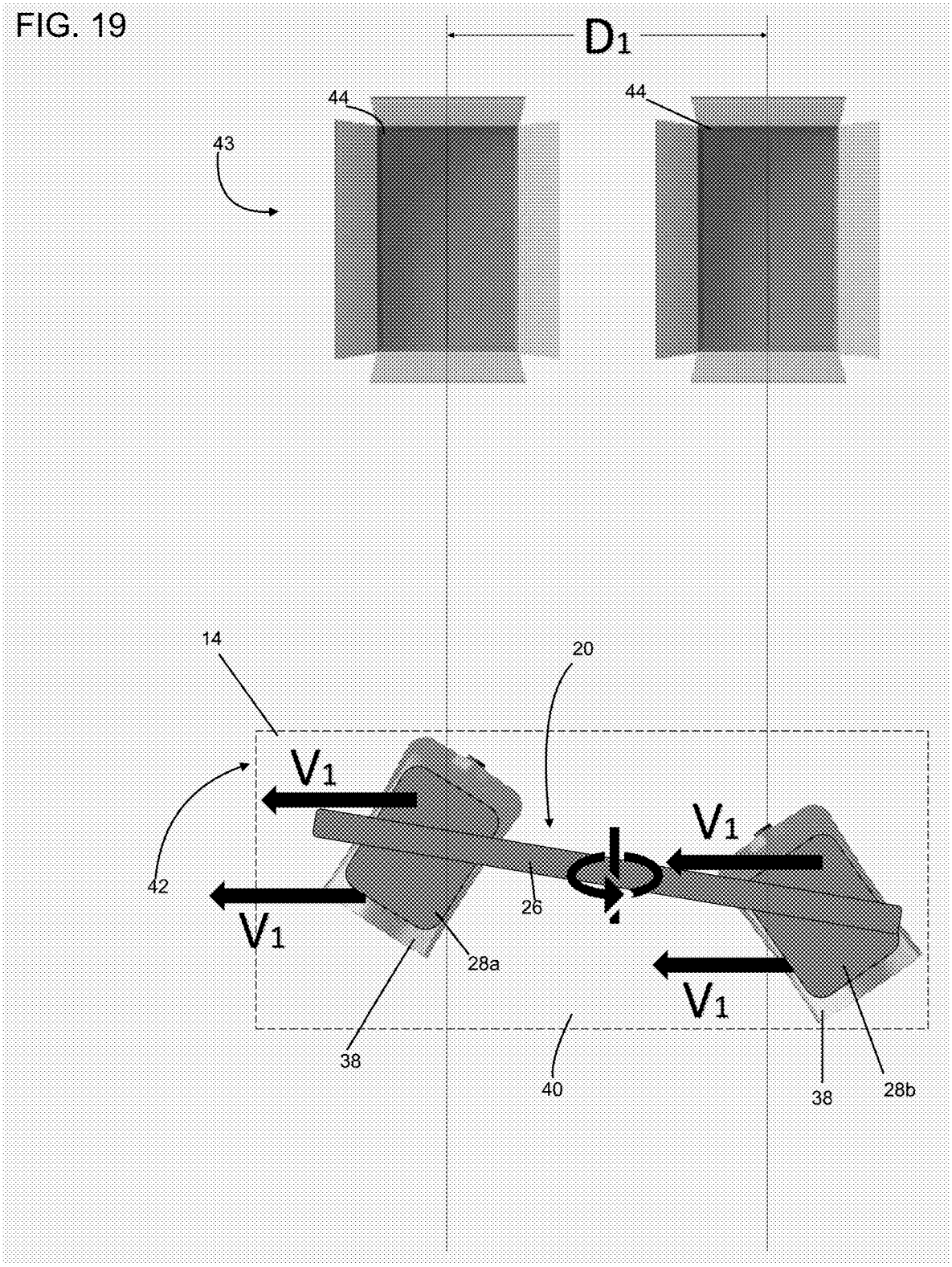
Figure 20:
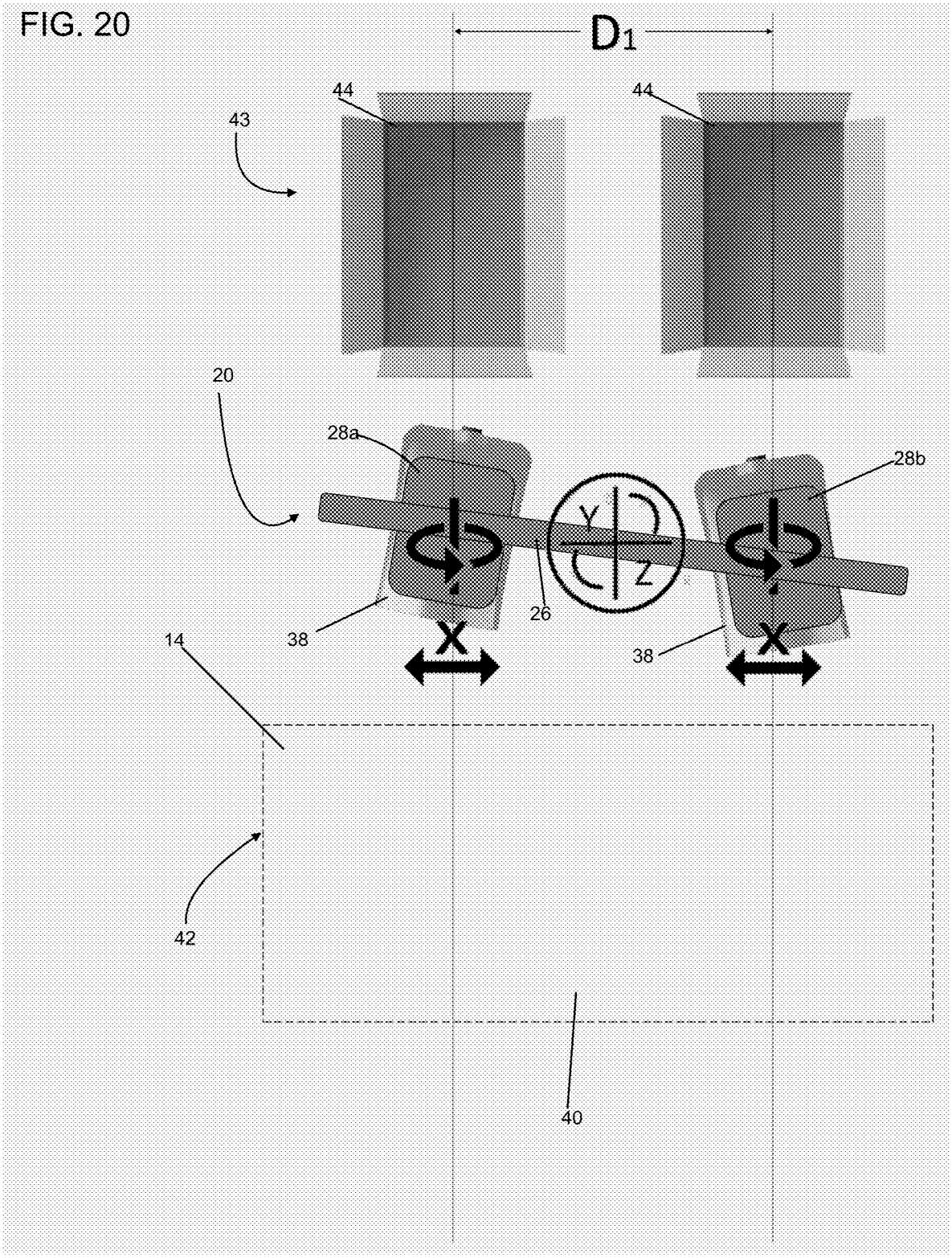
Figure 21:
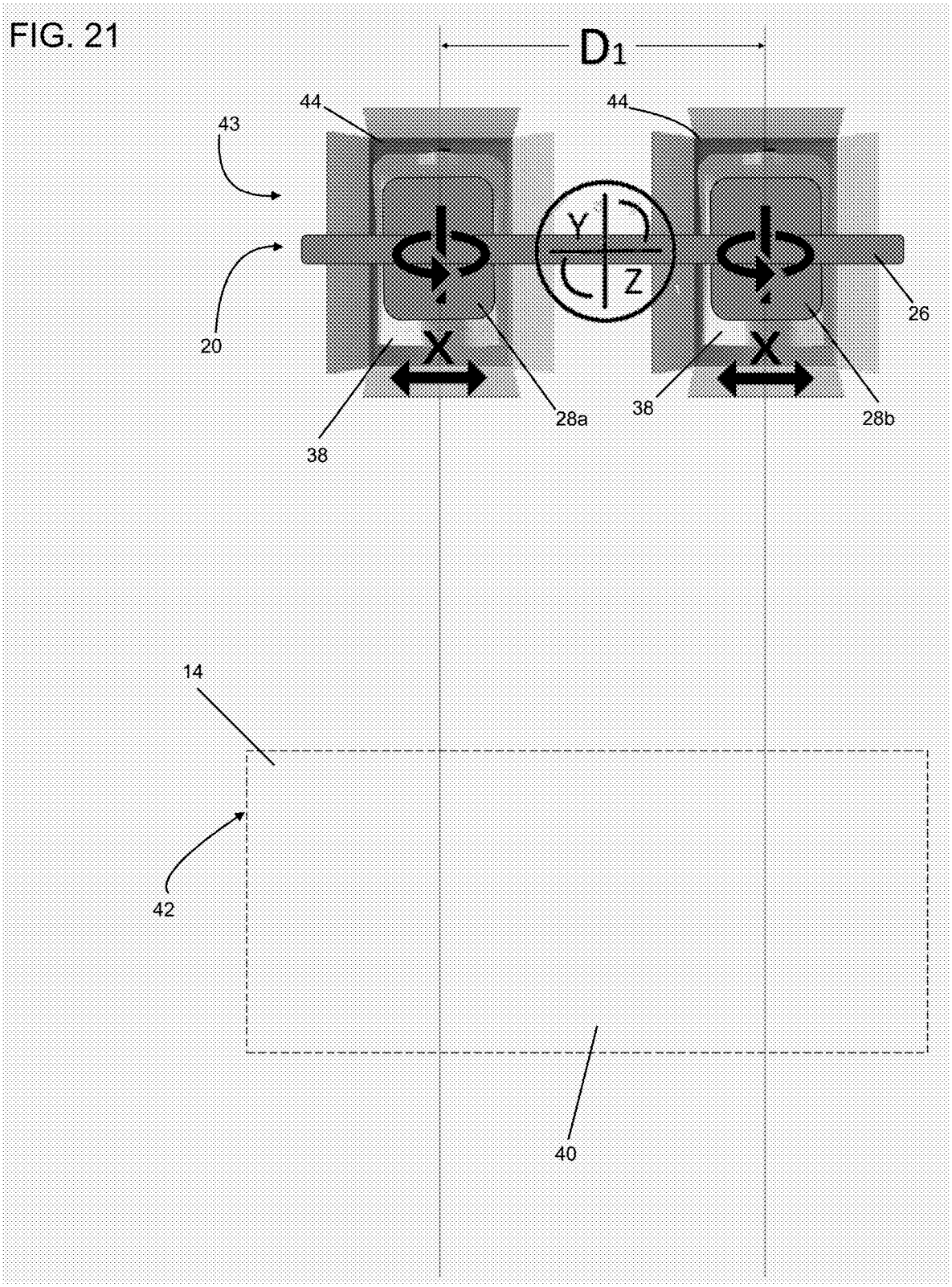

In this circumstance, as the assembly 20 moves to pick up the articles 38, such as in the manner shown in FIG. 18, the rail 26 will be rotated relative to the arm 24 so as to position each EOAT 28*a* and 28*b* into longitudinal alignment with each article 38. At the same time, the EOATs 28*a* and 28*b* will move along the rail to the appropriate spacing to match the lateral displacement of the articles 38 and each will be rotated to match the orientation of the article in proximity therewith, as shown in FIGS. 18 and 19.

Once again the articles 38 will then be picked up by the EOATs 28*a* and 28*b* and the assembly 20 moved to the waiting cases 44 that are positioned in the load area 43. Simultaneously, EOATs 28*a* and 28*b* will rotate as necessary to align the articles 38 with a desired packing position appropriate to each case 44 and then deposit each article 38 therein in the manner shown in FIGS. 20 and 21.

In FIGS. 22-26, an alternative embodiment of the system 10 (and its operation) is shown. In this sequence, the system 10 is shown provided with an assembly 20 having three EOATs 28*a*, 28*b*, and 28*c*. The manner of operation of this embodiment is the same as previously described, and is included to illustrate the manner in which more than two EOATs could be utilized by the system 10. In other embodiments, four or more EOATs could be incorporated into the system 10 in the same manner based on the principles illustrated.

Figure 22:
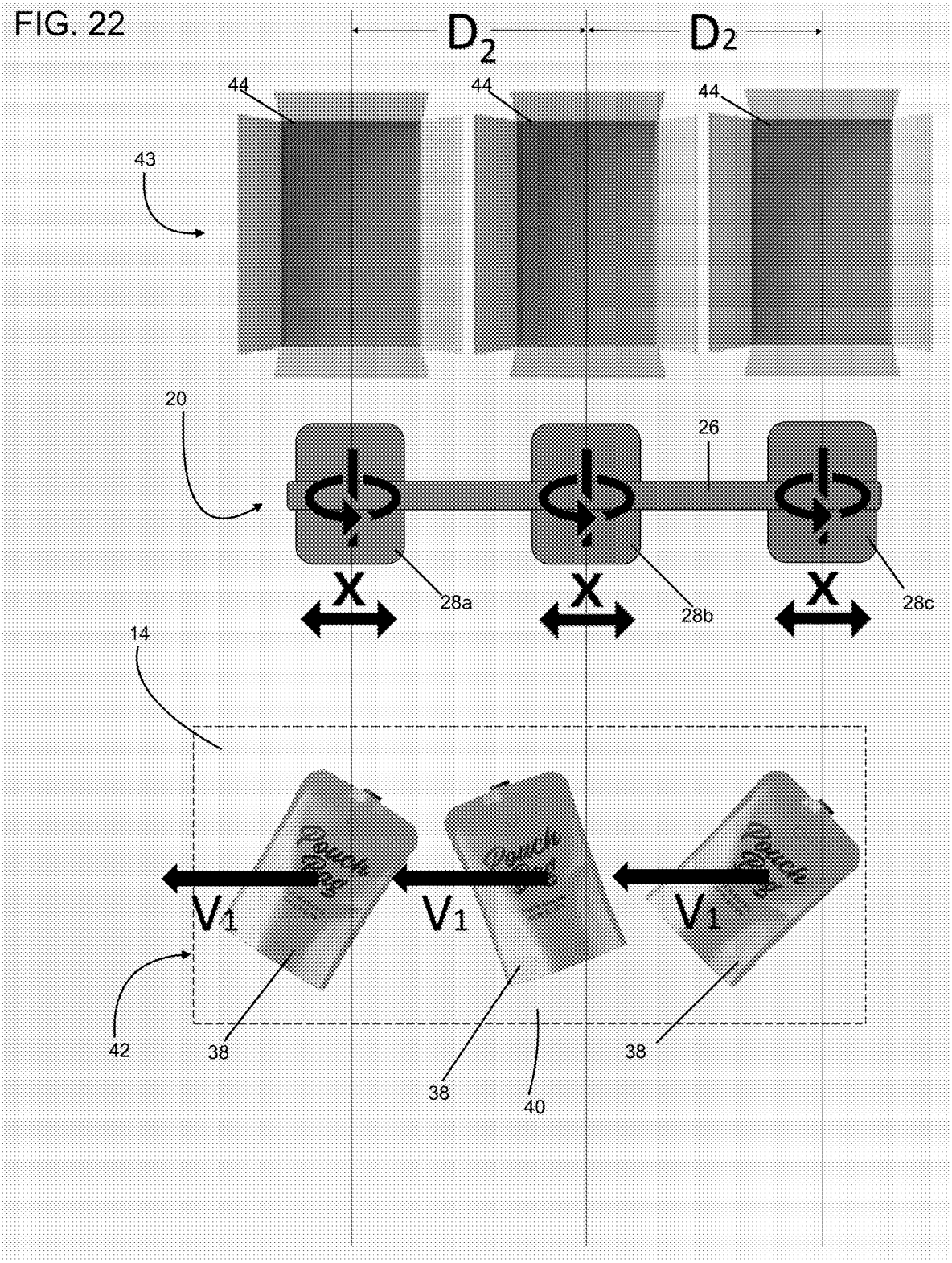
FIGS. 22-26 are top down conceptualized views of components of an alternative embodiment of the system shown in FIG. 1 wherein the robotic arm assembly includes three EOATs, and illustrating an operational sequence in which the speed, position, and orientation of multiple product articles are matched by the robotic arm assembly.

Beginning with FIG. 22, in this embodiment the system 10 is capable of picking and loading three articles 38 into between one and three cases 44, via the three EOATs 28*a*, 28*b*, and 28*c*. Here, the cases 44 are positioned in the load area 43 of the case loading conveyor, while three sensed articles 38 enter the pick area 42 of the article conveyor 14.

Figure 23:
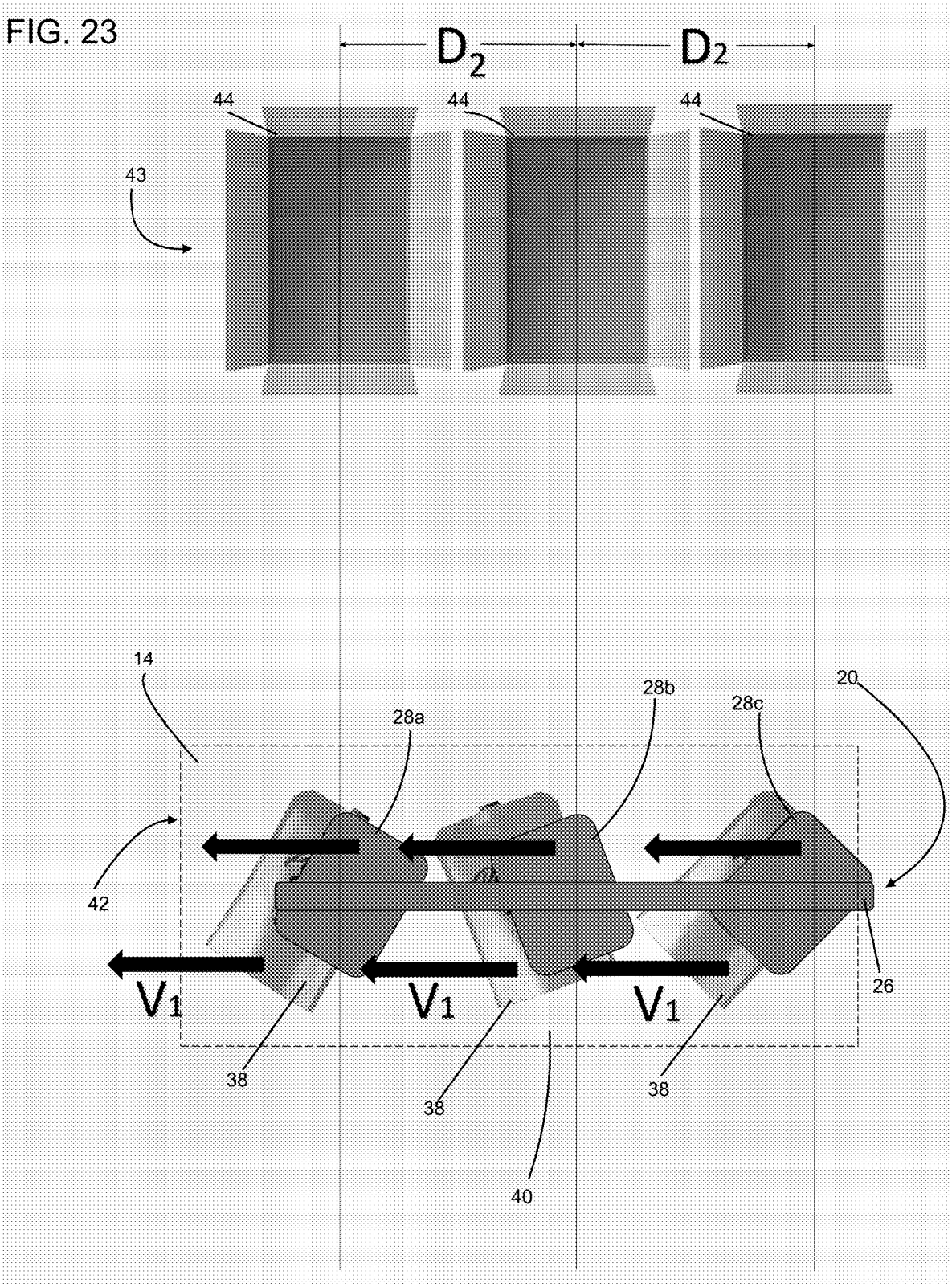
Figure 24:
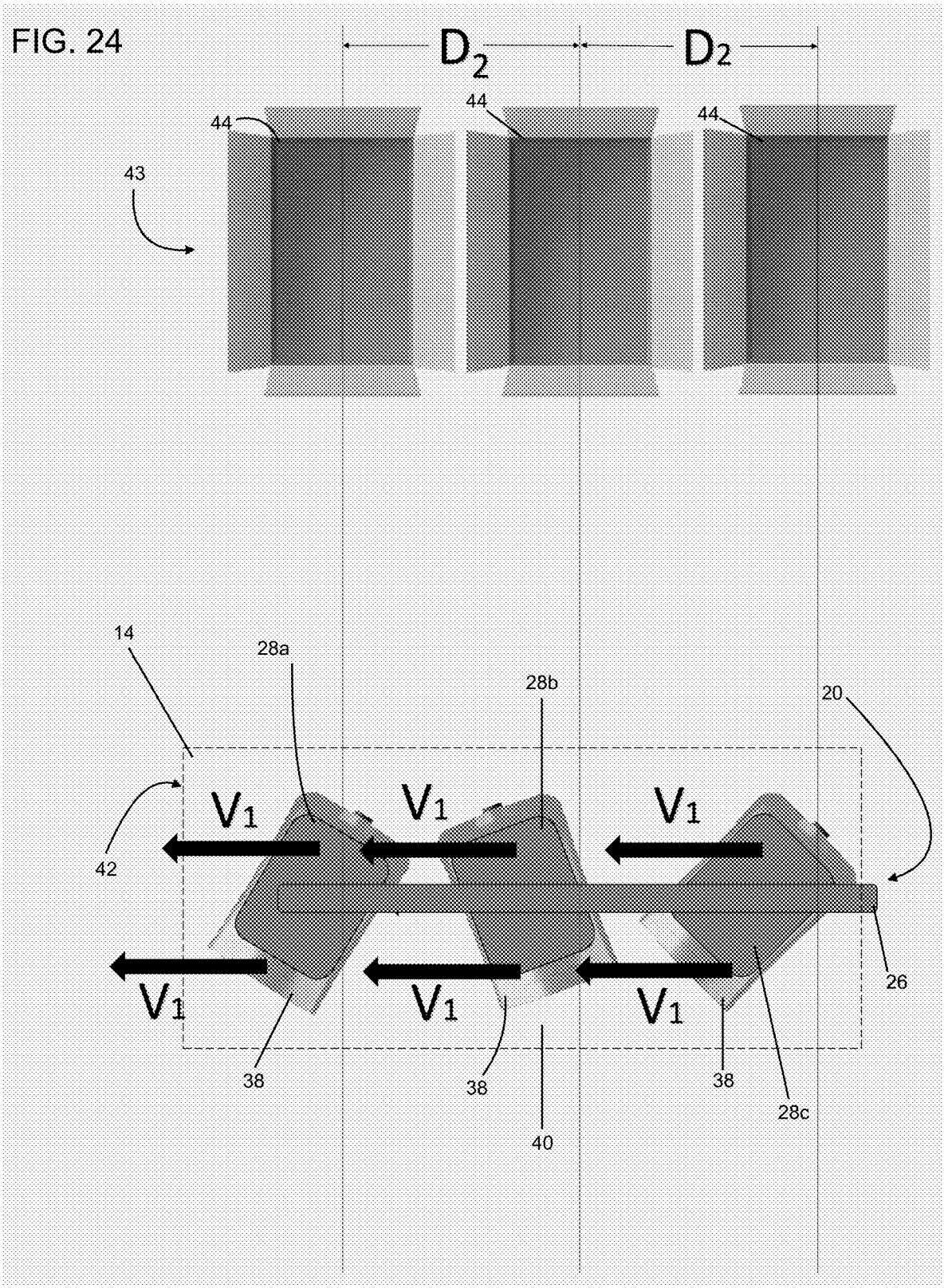

In operation, the assembly 20 will once again move to the pick area 42 and position each EOAT 28*a*, 28*b*, and 28*c* over one of the product articles 38, such that the assembly 20 matches the speed ($V_1$) of the articles as they advance on the article conveyor 14, while simultaneously positioning each EOAT 28*a*, 28*b*, and 28*c* over one of the articles 38 and matching its orientation as well, such as in the manner shown in FIGS. 23 and 24.

Matching the characteristics of the EOATs 28*a*, 28*b*, and 28*c* to that of articles 38 is done in the same manner as previously described, with the distinction that there are three EOATs capable of independent and coordinated movement along the rail 26 rather than two.

Figure 25:
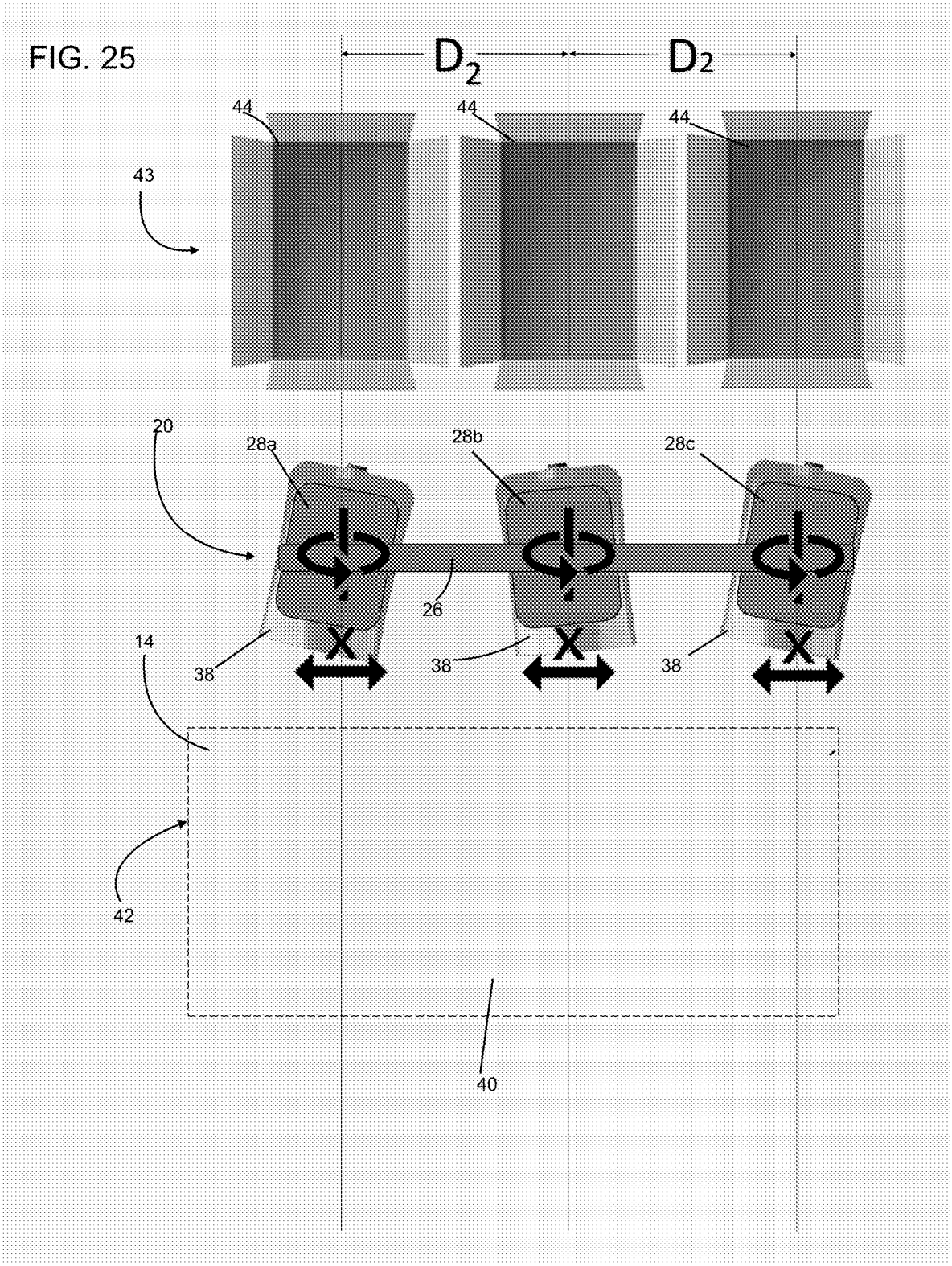
Figure 26:
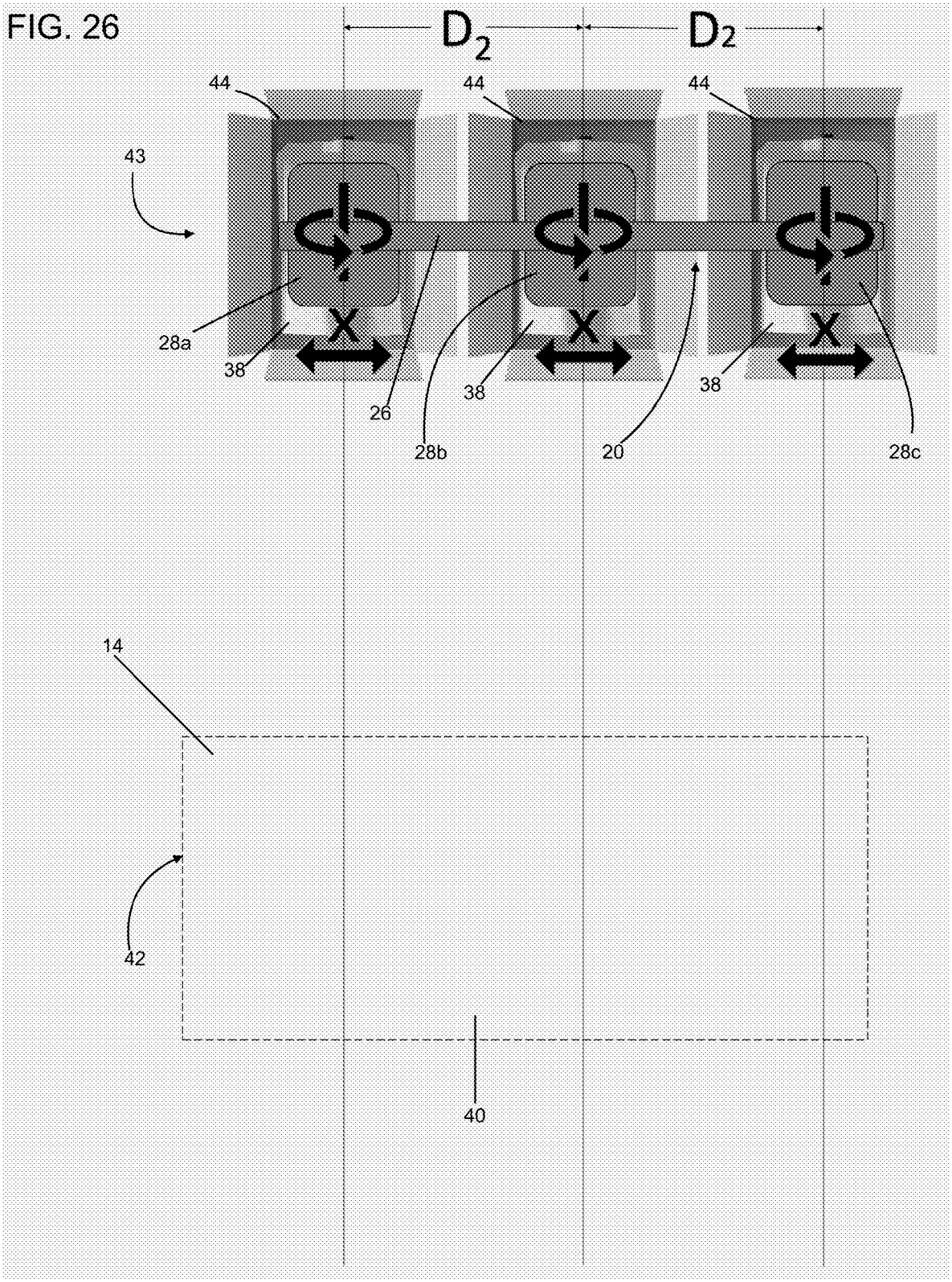

As shown in FIGS. 25 and 26, once the speed, position and orientation of the articles are matched by the EOATs 28*a*, 28*b*, and 28*c* the articles 38 will then be picked up by the EOATs 28*a*, 28*b*, 28*c* and the assembly 20 moved to the three waiting cases 44 that are positioned in the load area 43. Simultaneously, EOATs 28*a*, 28*b*, and 28*c* will rotate as necessary to align the articles 38 with a desired packing position appropriate to each case 44 and then deposit each article 38 therein.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A multiple case loading system comprises:

an article conveyor, a case conveyor, a robotic assembly supported by a frame and moveable in relationship to said frame, and a sensor in electronic communication with the robotic assembly;

a portion of the article conveyor defining a pick area, the pick area positioned adjacent to the frame and accessible by the robotic assembly;

a portion of the case conveyor defining a load area, the load area positioned adjacent to the pick area and adjacent to the frame and accessible by the robotic assembly, the robotic assembly having a vertical arm, a lateral rail and a plurality of end of arm tools (EOATs), the vertical arm having an apex and a base, the apex being moveably engaged to an actuator supported by the frame, the vertical arm configured to move freely relative to the frame via the actuator and between the pick area and the load area along an X-axis, a Y-axis and a Z-axis, the lateral rail being engaged to the base of the vertical arm, the lateral rail is rotatable relative to the vertical arm, each of the plurality of EOATs being slidably engaged to the lateral rail and being rotatable relative to the lateral rail;

the sensor positioned above an upstream location of the article conveyor and defining a detection area thereon, the sensor being configured to detect speed, position and orientation characteristics of a plurality of articles passing through the detection area and communicating those characteristics to the robotic assembly;

based on the detected characteristics of the plurality of articles, the robotic assembly is constructed and arranged to move each of the plurality of EOATs to match the speed, position and orientation characteristics of one of the plurality of articles, and then engage and pick up each one of the plurality of articles simultaneously, and then place each one of the plurality of articles separately and simultaneous into each one of a plurality of cases positioned in the load area.

2. The system of claim 1, wherein the base of the vertical arm is engaged to a center of the lateral rail.

3. The system of claim 1, wherein the frame defines an operational space, the load area, the pick area and the robotic assembly positioned within the operational space.

4. The system of claim 1, wherein the sensor is a motion sensor selected from at least one member of the group consisting of: video motion optical sensor, LIDAR based sensor, passive infrared (PIR) light sensors, microwave sensor, and ultrasonic sensor.

5. The system of claim 1, wherein the plurality of EOATs is a first EOAT and a second EOAT, each of the plurality of EOAT's are configured for independent and cooperative movement along the length of the lateral rail.

6. The system of claim 5, further comprising a third EOAT.

7. A robotic assembly for loading multiple articles into multiple cases comprises:

a vertical arm, a lateral rail and a plurality of end of arm tools (EOATs), the vertical arm having an apex and a base, the apex being moveably engaged to an actuator supported by a frame, the vertical arm configured to move freely relative to the frame via the actuator along an X-axis, a Y-axis and a Z-axis, the base of the vertical arm is engaged to a center of the lateral rail, the lateral rail is configured for rotational movement relative to the vertical arm, each of the plurality of EOATs are in communication with the actuator and are slidably engaged to the lateral rail, each of the plurality of EOATs are rotatable relative to the lateral rail.

* * * * *